US005707562A

United States Patent [19]

Karliner

[11] Patent Number: 5,707,562

[45] Date of Patent: Jan. 13, 1998

[54] TURBO AERATOR

[75] Inventor: Rudolf R. Karliner, Minnetonka, Minn.

[73] Assignee: Aeration Industries International, Inc., Chaska, Minn.

[21] Appl. No.: 642,504

[22] Filed: May 3, 1996

[51] Int. Cl.[6] ..... B01F 3/04

[52] U.S. Cl. ..... 261/91; 261/120

[58] Field of Search ..... 261/91, 120

[56] References Cited

U.S. PATENT DOCUMENTS

| | | | |
|---|---|---|---|
| 1,994,912 | 3/1935 | Hochstetter | 261/91 |
| 3,572,658 | 3/1971 | Ravitts | 261/36 |
| 3,640,514 | 2/1972 | Albritton | 261/91 |
| 3,669,422 | 6/1972 | Nogaj | 261/34 |
| 3,797,809 | 3/1974 | Sydnor, Jr. | 261/91 |
| 3,836,130 | 9/1974 | Earhart et al. | 261/91 |
| 4,145,383 | 3/1979 | Randall | 261/91 |
| 4,242,199 | 12/1980 | Kelley | 261/91 |
| 4,318,871 | 3/1982 | Mentz | 261/120 |
| 4,350,648 | 9/1982 | Watkins et al. | 261/91 |
| 4,468,358 | 8/1984 | Haegeman | 261/91 |
| 4,540,528 | 9/1985 | Haegeman | 261/91 |
| 4,734,235 | 3/1988 | Holyoak | 261/91 |
| 5,021,154 | 6/1991 | Haegeman | 210/221.2 |
| 5,110,510 | 5/1992 | Norcross | 261/91 |

FOREIGN PATENT DOCUMENTS

| | | | |
|---|---|---|---|
| 989298 | 4/1965 | United Kingdom | 261/91 |

*Primary Examiner*—Tim R. Miles

*Attorney, Agent, or Firm*—Nawrocki, Rooney & Sivertson

[57] ABSTRACT

Apparatus for use in aeration of a fluid. The apparatus includes a power unit having a rotatable shaft. An impeller is coupled to the shaft. The impeller has a blade with a generally uniform outside diameter. A diffuser head is positioned proximate the impeller. The impeller may be a screw impeller. The diffuser head may be a stepped diffuser head.

10 Claims, 4 Drawing Sheets

TURBO AERATOR

BACKGROUND OF THE INVENTION

The present invention relates to an aerator for treatment of fluid by aeration. More particularly, the present invention relates to a high efficiency aeration apparatus having improved fluid pumping and aeration/oxygenation performance.

Aeration processes are utilized in the treatment of fluid for the purpose of mixing and increasing the dissolved oxygen (DO) content of the fluid. When used in a waste water treatment aerobic or activated sludge process, bacteria and other micro-organisms are supplied with dissolved oxygen to break down organic matter within the waste water. In other applications, aeration processes are used in the treatment of water to meet the dissolved oxygen requirements for supporting fish life and other aquatic organisms.

Mechanical aerators agitate the water to promote the solution of air from the atmosphere into the water. Mechanical surface aerators generally include a float-supported motor coupled to a submerged propeller. The propeller agitates the water to entrain air in the water for improving the water dissolved oxygen content.

Aeration apparatus used to increase the dissolved oxygen content of various substances are known. U.S. Pat. No. 4,318,871 to Mentz suggests a surface aerator apparatus. The surface aerator apparatus generally includes a motor mounted on a float structure. The motor drives a shaft coupled to a paddle wheel or propeller located within a tube extending below the float. In operation, as the propeller is rotated, waste water is drawn up through the tube and guided outward by the defuser positioned above the float.

Haegeman, U.S. Pat. No. 4,540,528, suggests an apparatus for mixing gas and liquid. The apparatus includes a motor mounted on a float structure. A housing extends below the float structure. An impeller having a rotating diffuser head comprised of outwardly extending curved or flared blades is connected to the motor shaft, and partially extends into the housing. In operation, as the impeller is rotated, water is drawn upward and thrown outward by the flared impeller blades.

Known apparatuses do not adequately diffuse the fluid into streams or droplets for optimum oxygenation of the fluid, to maximize the dissolved oxygen content of the fluid during treatment. It is highly desirable to have a surface aerator with efficient pumping capabilities. Further, it is highly desirable to have a surface aerator which provides optimum exposure of water streams or droplets with atmospheric air for increasing the dissolved oxygen content in the water.

SUMMARY OF THE INVENTION

The present invention is an apparatus for efficient pumping and aeration of a fluid. The present invention is for use in fluid treatment processes for improving the dissolved oxygen content within the fluid.

In one embodiment, the apparatus includes a power unit having a rotatable shaft. An impeller is coupled to the shaft. The impeller has a blade with a generally uniform outside diameter. A diffuser head is positioned above the impeller.

The diffuser head may be a stepped diffuser head. The diffuser head may be stationary relative to the power unit. The diffuser head may include a curved region and a stepped region. The curved region may be formed integral the stepped region. Alternatively, the curved region may be replaceable, and formed separate from the stepped region. The stepped region may further include a first step and a second step.

The impeller may be a screw impeller. In one embodiment, the shaft extends through the diffuser head, and the impeller begins at a location proximate the diffuser head. The present invention may further include a tubular member. The impeller blade may include a first end and a second end, wherein the second end extends into the tubular member.

In another embodiment of the present invention for use in improving the dissolved oxygen content of a fluid, the apparatus includes a shaft. Means are provided for rotating the shaft. Diffusion means are located about the shaft. A draft tube may be provided. The apparatus may include an impeller system coupled to the shaft rotatable about its longitudinal axis.

The impeller system may include an impeller blade having a first end and a second end. The first end may be positioned proximate the diffusion means, and the second end may be positioned within the draft tube.

The impeller blade first end may be located exterior the draft tube. The impeller system may be a screw impeller. The impeller blade may have a generally uniform outer diameter. The diffusion means may include a stepped diffuser head.

BRIEF DESCRIPTION OF THE DRAWINGS

Many of the attendant advantages of the present invention will be readily appreciated as the same becomes better understood by reference to the following detailed description when considered in connection with the accompanying drawings in which like reference numerals designate like parts throughout the figures thereof, and wherein.

DETAILED DESCRIPTION OF THE PREFERRED EMBODIMENTS

Figure 1:
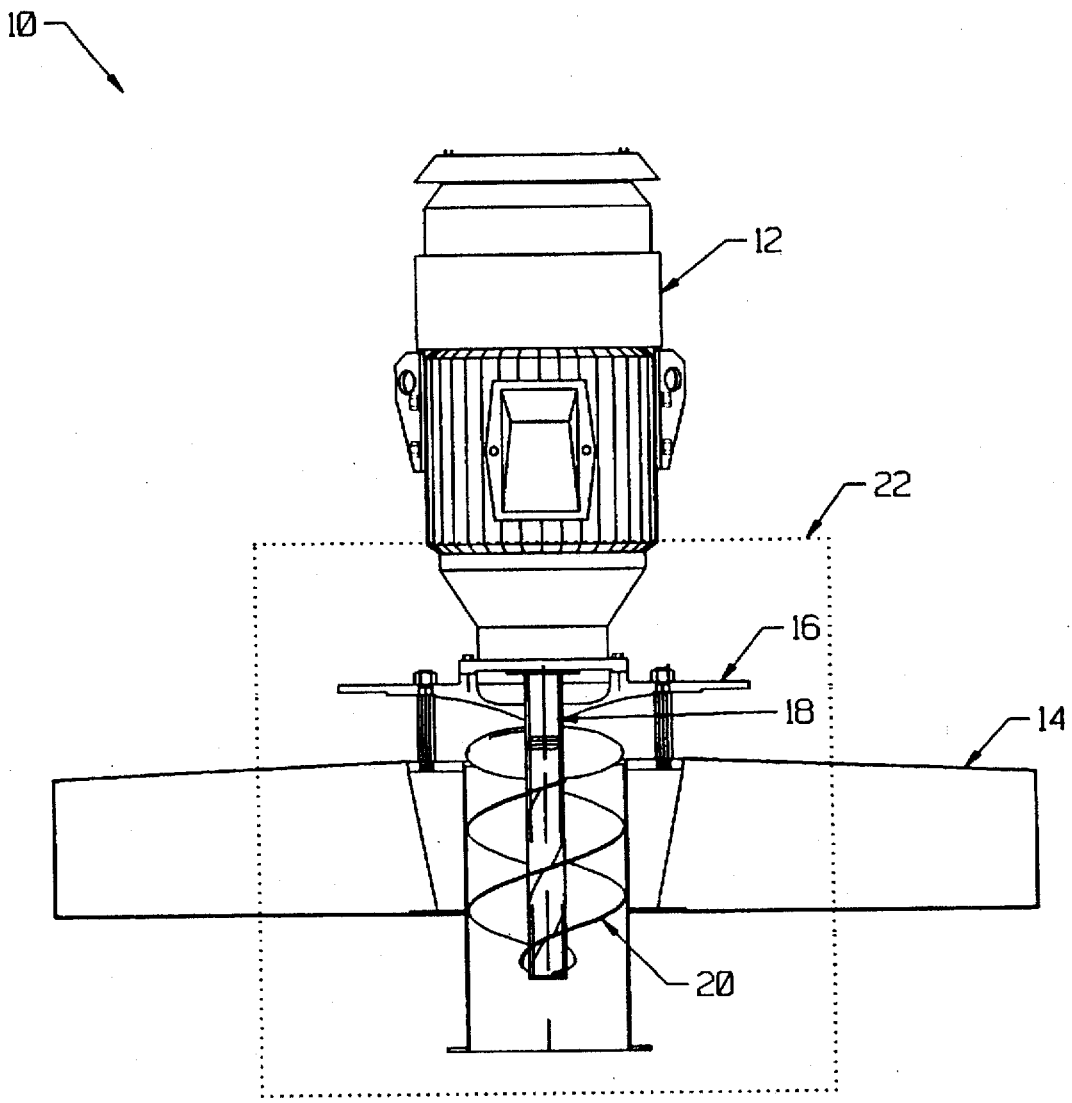
FIG. 1 is an elevational view showing one embodiment of an aeration apparatus in accordance with the present invention.

FIG. 1 shows an aeration apparatus in accordance with the present invention generally shown at 10. Aeration apparatus 10 is an aerator or oxygenator used for efficient mixing of air with a fluid in a fluid treatment system.

In one embodiment, aeration apparatus 10 is a surface aerator used in the treatment of water for the purpose of mixing and increasing the dissolved oxygen content of the water. Aeration apparatus 10 generally includes a power unit or motor 12 supported by support system or float system 14. Positioned between float system 14 and motor 12 is stepped diffuser head 16. A rotatable shaft 18 extends through diffuser head 16 from motor 12. The motor shaft 18 extends below diffuser head 16 and is coupled proximate its end to impeller system 20.

Figure 2:
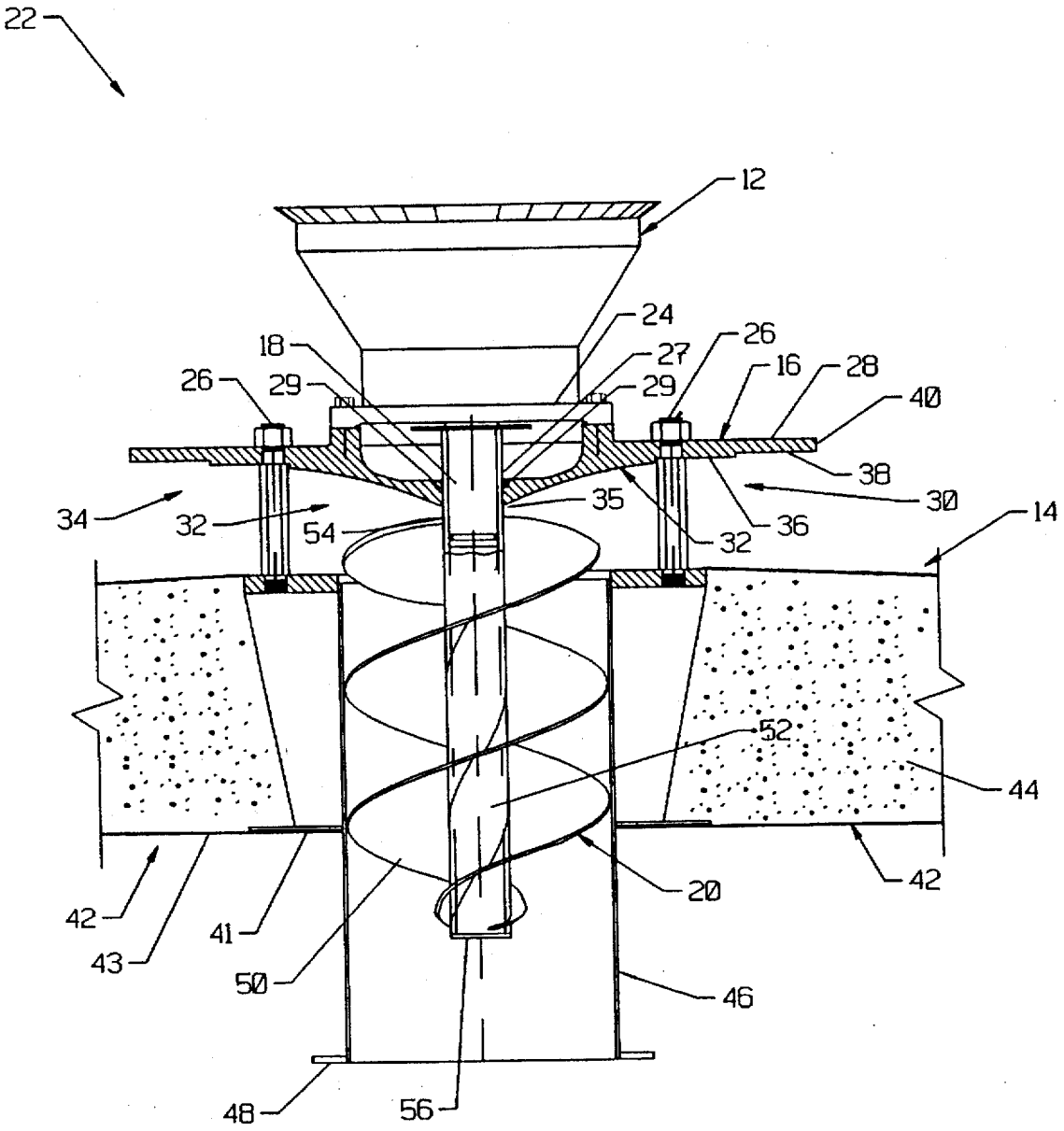
FIG. 2 is an enlarged partial elevation showing the lower portion of the aeration apparatus of FIG. 1.

Referring to FIG. 2, an enlarged elevational view of the lower portion of aeration apparatus 10 is shown at 22. In one embodiment, motor 12 includes flange 24 located proximate its lower end. Motor 12 is coupled to diffuser head 16 at flange 24 using bolt connections 26.

Diffuser head 16 (shown in cross section) is positioned about shaft 18 and is maintained stationary relative to motor 12 and/or float system 14. Diffuser head 16 is coupled to float system 14, indicated at 26. In one embodiment, diffuser head 16 may include center opening 27 for motor shaft 18 to pass therethrough. A radial lip seal 29 seals the diffuser head 16 to the motor shaft 18.

For efficient fluid atomization, diffuser head 16 is a stepped diffuser head, and includes a generally flat top surface 28 and a stepped bottom surface 30. Bottom surface 30 includes a curved portion 32 and stepped portion 34. Curved portion 32 begins at bottom end 35 (located adjacent shaft 18), extending radially from a center longitudinal axis outward and upward, gently curving to stepped portion 34. In one embodiment, stepped portion 34 includes first step 36 and second step 38. First step 36 is a generally flat circumferential notch located between curved portion 32 and second step 38, and generally concentrically around shaft 18. Similarly, second step 38 is a generally flat circumferential notch located adjacent first step 36 along the outside edge 40 of diffuser head 16, and generally concentrically around shaft 18.

In one embodiment, the float system frame 42 is a metallic frame, which is preferably formed of a corrosion resistant material, such as aluminum, stainless steel, or an aluminum alloy. It is also recognized that frame 42 may be a non-metallic frame. Frame 42 includes frame center portion 41 and circumferential frame extension 43. Located within frame extension 43 is foam 44, to provide buoyancy to float system 14.

Coupled to frame 42 is draft tube 46. Draft tube 46 (shown in cross-sectional view) is a generally tubular member, extending through the center of float system 14. In one embodiment, draft tube 46 extends from an upper edge of float system 14 to a location beneath float system 14. In one embodiment, draft tube 46 is metallic and formed of steel. Located at the lower edge of draft tube 46 is a circumferential flange 48. Flange 48 extends outward from the outer surface of draft tube 46. Although draft tube 46 preferably has a generally uniform inside diameter, it is recognized that draft tube 46 may increase to a larger inside diameter at its lower edge.

Impeller system 20 is positioned within draft tube 46. Impeller system 20 is coupled to motor shaft 18 for rotation about its longitudinal axis. The impeller system 20 generally includes an impeller blade 50 extending about impeller shaft 52. In one embodiment, top end 54 is located proximate the diffuser head bottom end 35 and extends above float system 14 and/or draft tube 46. The impeller system 20 bottom end 56 is located proximate the bottom end of draft tube 46 (or flange 48). The bottom end 56 may extend below float system 14.

As impeller blade 50 extends upward from the bottom end 56 of impeller shaft 52, impeller blade 50 has a generally constant outside diameter to allow impeller blade 50 to be movably positioned within throat 46. The inside diameter of throat 46 can also be constant, and slightly greater than the diameter of blade 50. In one embodiment, the impeller system 20 includes a screw impeller having a constant pitch between top end 54 and bottom end 56. The pitch varies according to the horse power.

Figure 3:
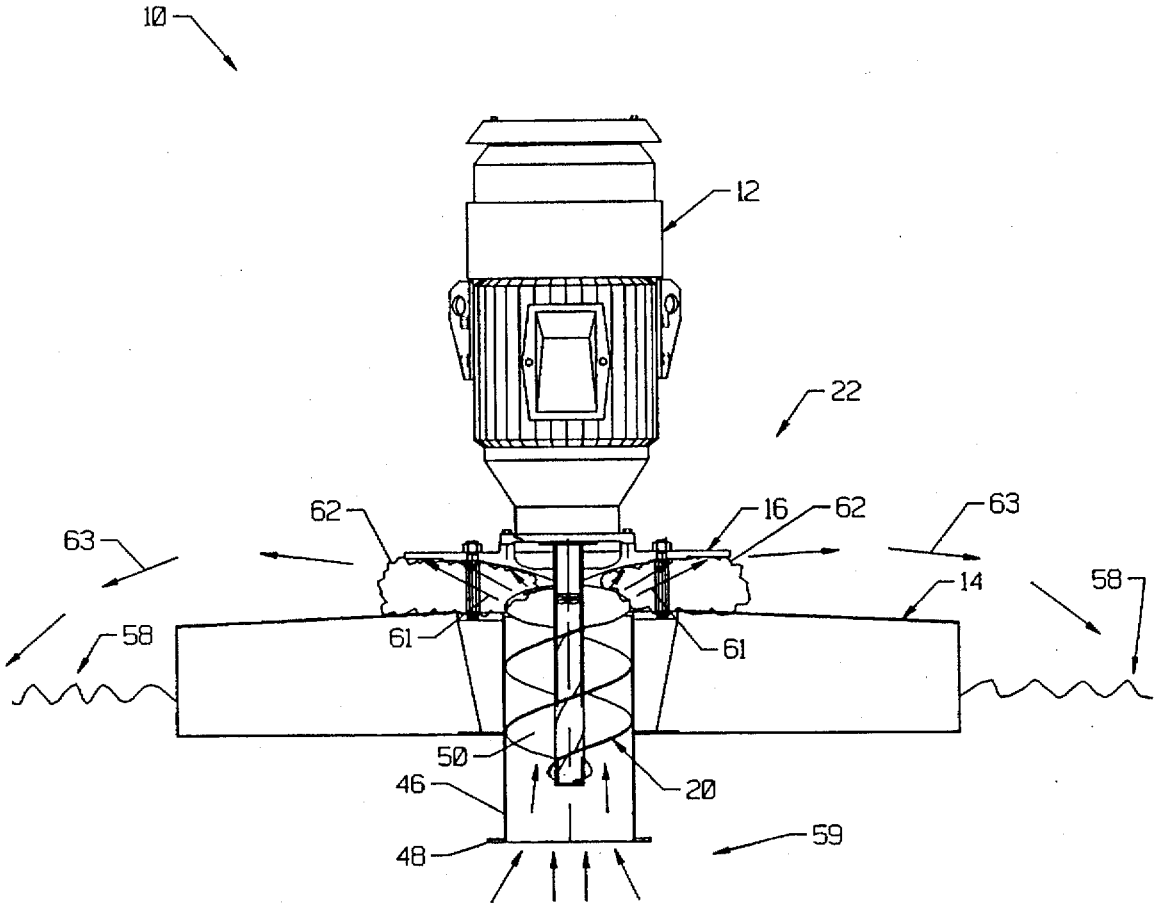
FIG. 3 is an elevational view showing the aeration apparatus of FIG. 1 in operation.

Referring to FIG. 3, aeration apparatus 10 is shown in operation (in FIG. 3, several element numbers have been omitted for clarity). In the embodiment shown, aeration apparatus 10 is operated as a surface aerator for improving the dissolved oxygen content in a fluid. Aeration apparatus 10 floats on the surface of fluid (or water) 58, supported by float system 14. Motor 12 is coupled to a control system (not shown) for selective energization of the aeration apparatus 10.

To perform an aeration process, motor 12 is energized to rotate motor shaft 18. As motor shaft 18 rotates, impeller system 20, which is coupled to shaft 18, rotates about its longitudinal axis within draft tube 46. As impeller system 20 rotates about its longitudinal axis extending through draft tube 46, water is drawn (or sucked) upward into draft tube 46 at flange 48, indicated by directional arrows 59.

Upon reaching impeller blade 50, water is pumped upward through draft tube 46 at a relatively high rate. The unique design of impeller system 20 in accordance with the present invention provides for improved efficient pumping of water 58 up through draft tube 46. Impeller blade 50 circulates water 58 upward until it reaches top end 54, where it is dispersed and guided upward and radially outward at top end 54 by stationary diffuser head 16.

Diffuser head 16 operates to break or atomize water 58 into droplets and atomization streams 60 to maximize the solution of atmospheric air with water 58. Accordingly, this process increases the dissolved oxygen content of water 58.

In one preferred embodiment, impeller system 20 violently throws water 58 against bottom surface 30 for atomization of water 58, indicated by turbulent water cloud/atomization cloud 62. As water 58 is thrown against curved portion 32, first step 36, and second step 38, (indicated by directional arrows 61) water 58 is broken up into water droplets and streams 60, shown as atomization cloud 62. Further, the edges of curved portion 32, first step 36, and second step 38 allow for improved atomization and turbulence within cloud 62 for dispersing the water 58 into droplets and water streams 60.

Figure 4:
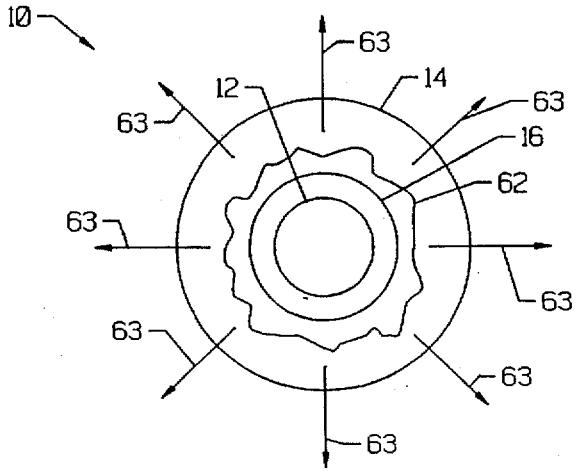
FIG. 4 is a top view showing the aeration apparatus of FIG. 1 in operation.

Referring to FIG. 4, since impeller blade 50 extends above float system 14, proximate the diffuser head 16, water 58 is thrown against diffuser head 16 to form cloud 62, and continues in a path outward over float system 14 back into the water 58 (indicated at 63).

The unique design of impeller system 10 allows for efficient pumping of water 58 into the aeration apparatus 10. Further, the unique design of aeration apparatus 10 allows for efficient aeration and oxygenation of water 58 by breaking water 58 into droplets or streams for mixing water with air, improving the dissolved oxygen content of the water 58.

Figure 5:
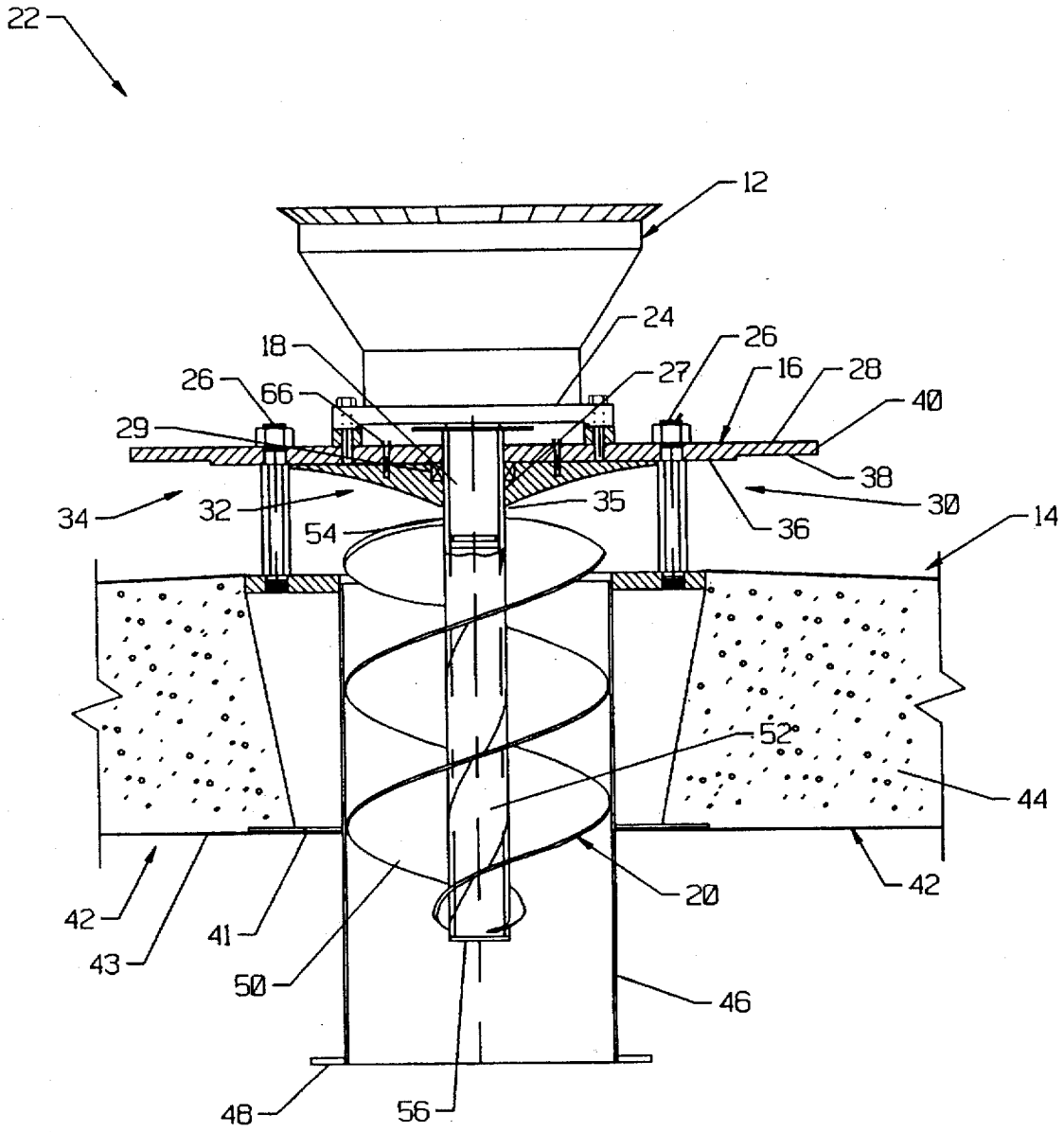
FIG. 5 is an enlarged partial elevational view showing an alternative embodiment of the diffuser head in accordance with the present invention.

Referring to FIG. 5, another embodiment of the present invention is shown. The curved portion 32 and stepped portion 34 of diffuser head 16 are formed in two separate parts. The curved portion 32 is removably connected (for example by a bolted connection as shown) to the bottom side of stepped portion 34. With this embodiment, curved portion 32 is replaceable, and may be changed out for another curved portion if required during maintenance of the aeration apparatus 10. Curved portion 32 may be changed out to a differently configured curved portion 32. In one embodiment, curved portion 32 is replaced by loosening bolts 66, and removed. A second curved portion 32 is positioned underneath stepped portion 34 and lip sealed against shaft 18. Bolts 66 are turned tight, fixedly securing the curved portion 32 against the bottom side of the stepped portion 34.

It will be understood that this disclosure is, in many respects, only illustrative. Changes may be made in details, particularly in matters of shape, size, material, and arrangement of parts, without exceeding the scope of the invention. Accordingly, the scope of the invention is as defined in the language of the appended claims.

What is claimed is:

1. An apparatus for use in aeration of a fluid, the apparatus comprising:

a power unit having a rotatable shaft, an impeller coupled to the shaft, having a blade with a generally uniform outside diameter; and a diffuser head positioned proximate the impeller, the diffuser head includes a curved region and a stepped region, and the stepped region includes a first step and a second step.

2. The apparatus of claim 1, wherein the diffuser head is stationary relative to the power unit.

3. The apparatus of claim 1, wherein the diffuser head curved region is removably connected to the stepped region.

4. The apparatus of claim 1, wherein the impeller is a screw impeller.

5. The apparatus of claim 1, wherein the shaft extends through the diffuser head, and the impeller blade begins at a location proximate the diffuse head.

6. The apparatus of claim 1, further including:

a tubular member; and the impeller blade includes a first end and a second, wherein the second end extends into the tubular member.

7. An apparatus for use as a surface aerator in the treatment of water, the apparatus comprising:

a motor having a rotatable shaft;

a support structure coupled to the motor;

a tubular member coupled to the support structure, the tubular member including an upper end and a lower end;

a diffuser head held stationary relative to the support structure, the shaft extending through the diffuser head; and an impeller system coupled proximate the end of the shaft, including an impeller shaft and an impeller blade located about the impeller shaft, the impeller blade having a generally uniform outside diameter, the impeller system extends into the tubular member, the impeller blade including a first end and a second end, the second end of the impeller blade is positioned within the tubular member, and the first end of the impeller blade extends above the upper end of the tubular member and is spaced from the diffuser head.

8. The apparatus of claim 7, wherein the impeller system is a screw impeller.

9. The apparatus of claim 7, wherein the diffuser head is a stepped diffuser head.

10. The apparatus of claim 7, wherein the support structure is a float system.

* * * * *